US010508510B2

(12) United States Patent
Engevik et al.

(10) Patent No.: US 10,508,510 B2
(45) Date of Patent: Dec. 17, 2019

(54) BOTTOM HOLE ASSEMBLY FOR CUTTING AND PULLING A TUBULAR

(71) Applicant: Baker Hughes, LLC, Houston, TX (US)

(72) Inventors: Thor-Harald Engevik, Houston, TX (US); Rune Jensen, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 247 days.

(21) Appl. No.: 15/825,861

(22) Filed: Nov. 29, 2017

(65) Prior Publication Data

US 2019/0162033 A1 May 30, 2019

(51) Int. Cl.

| | |
|---|---|
| ***E21B 29/00*** | (2006.01) |
| ***E21B 31/20*** | (2006.01) |
| ***E21B 37/02*** | (2006.01) |
| ***E21B 23/01*** | (2006.01) |

(52) U.S. Cl.

CPC ..... *E21B 29/005* (2013.01); *E21B 23/01* (2013.01); *E21B 31/20* (2013.01); *E21B 37/02* (2013.01)

(58) Field of Classification Search

CPC ..... E21B 23/01; E21B 29/005; E21B 31/20; E21B 37/02

See application file for complete search history.

(56) References Cited

U.S. PATENT DOCUMENTS

| | | | | |
|---|---|---|---|---|
| 1,645,010 | A * | 10/1927 | Kinley | E21B 31/20 166/215 |
| 2,177,721 | A | 10/1939 | Johnson et al. | |
| 3,217,803 | A * | 11/1965 | Winger | E21B 43/10 166/301 |
| 4,706,745 | A * | 11/1987 | Bishop | E21B 31/20 166/301 |
| 5,253,710 | A * | 10/1993 | Carter | E21B 31/20 166/216 |
| 5,361,834 | A | 11/1994 | Cox | |
| 6,206,101 | B1 * | 3/2001 | Bakke | E21B 31/1135 166/301 |
| 7,066,265 | B2 | 6/2006 | Surjaatmadja | |
| 7,401,651 | B2 | 7/2008 | Shkurti | |
| 7,472,746 | B2 | 1/2009 | Maier et al. | |
| 8,100,187 | B2 * | 1/2012 | Begnaud | E21B 19/07 166/380 |

(Continued)

FOREIGN PATENT DOCUMENTS

GB 2533022 A * 6/2016 ..... E21B 23/04

*Primary Examiner* — Daniel P Stephenson
(74) *Attorney, Agent, or Firm* — Shawn Hunter

(57) ABSTRACT

A bottom hole assembly (BHA) incorporates a tubular cutter driven by a downhole motor. A scraper moves into a smaller tubular to clean an area where a spear will later be engaged to the cut tubular portion. The scraper has a relatively movable mandrel that allows straight through flow into the motor or closes flow to build pressure to a telescoping jack to exert a pull force on the cut tubular after the cut is made. The spear is articulated with mandrel manipulation to grab the cut segment and weight is set down to shift the mandrel in the scraper to allow pressure buildup with rig pumps turned on to retract the jack as the BHA is held with anchors in the larger tubular. The cut segment is pulled uphole to loosen it so it can be removed from the borehole.

12 Claims, 2 Drawing Sheets

(56) References Cited

U.S. PATENT DOCUMENTS

| | | | | |
|---|---|---|---|---|
| 8,869,896 | B2 | 10/2014 | Crow et al. | |
| 8,893,791 | B2 * | 11/2014 | Crow | E21B 31/16 166/298 |
| 9,045,958 | B2 * | 6/2015 | Eddison | E21B 29/00 |
| 9,416,635 | B2 * | 8/2016 | Hekelaar | E21B 43/112 |
| 10,047,582 | B2 * | 8/2018 | Hekelaar | E21B 29/005 |
| 2010/0200218 | A1 | 8/2010 | Palidwar et al. | |
| 2012/0048535 | A1 | 3/2012 | Ruttley et al. | |
| 2012/0285684 | A1 * | 11/2012 | Crow | E21B 31/20 166/298 |
| 2014/0027117 | A1 | 1/2014 | Hekelaar et al. | |
| 2019/0162046 | A1 * | 5/2019 | Engevik | E21B 29/005 |
| 2019/0284894 | A1 * | 9/2019 | Schmidt | E21B 31/20 |

* cited by examiner

BOTTOM HOLE ASSEMBLY FOR CUTTING AND PULLING A TUBULAR

FIELD OF THE INVENTION

The field of the invention is systems and methods for cutting a tubular and jacking up the cut section for removal and more particularly a bottom hole assembly that reconfigures flow between a downhole motor for cutting and a telescoping jack and spear for pulling up the cut segment of the tubular string.

BACKGROUND OF THE INVENTION

Devices that cut tubulars have been used in a variety of applications and in some cases in conjunction with removal of the piece that is cut free as a result of the cut. Some packers are released with mandrel cutting and wells can be abandoned with removal of a section of tubular followed by reaming and creating a plug such as with cement. Tubular cutting can take place with the tubular being cut having been cemented and in those instances the cement can exert a powerful grip on the cut section of tubular making removal after the cut more difficult. To counter this resisting force jacking devices that are surface mounted have been use as described in US2012/0048535 and U.S. Pat. No. 5,361,834. Other ideas have involved a grip device with slips that have wickers that are uphole oriented to dig further into the cut piece of the tubular to remove it, as shown in US 2014/0027117. Hydraulically operated grapple devices are illustrated in US 2014/0027117.

Valves actuated with mandrel motion relative to an outer assembly such as a packer sealing and grip assembly or drag blocks are illustrated in U.S. Pat. Nos. 8,869,896; 7,066,265; US 2010/0200218; U.S. Pat. Nos. 7,472,746; 7,401,651 and 2,177,721.

The present invention focuses on a bottom hole assembly (BHA) and related methods for accomplishing the cut, preferably with a downhole motor and casing cutter and then reconfiguring BHA flow to operate a telescoping jacking tool to raise the cut segment. The flow reconfiguration is accomplished with a combination tool that scrapes a location where a grapple will be set wherein relative mandrel movement cuts flow to the downhole motor and redirects flow to the jacking tool. With a spear engaged the jacking tool breaks loose the cut section of tubular so that it can be removed from the borehole while supported by the grapple. The method entails running in a BHA until the scraper enters smaller casing after passing through larger casing. This signals surface personal that the cutter has approached the desired cut location. After scraping an area where the grapple will ultimately grip the flow commences and is directed to a mud motor that drives the cutter. An anchor on the BHA is extended into the larger tubing during the tubular cutting. The backpressure from the tubular cutting may initially raise the cutter assembly a distance equal to the stroke length of the telescoping jacking tool. At the onset of the cutting the grapple or spear is not engaged so that shifting the cutter blades axially before the cutting gets too far underway is not a problem as the stroke length of the telescoping jacking tool is fairly short, in the order of 0.5 meters. After the cut is concluded, the flow is cut off and the BHA is lowered to engage the top of the smaller tubular string with a radial travel stop. Cutting off the flow retracts the BHA anchors to permit this movement. The BHA is then raised to engage the spear to the cut segment. The BHA is lowered to close flow to the mud motor and the pumps are turned on to pressure the string and the telescoping jack device and its associated anchors. The telescoping jack contracts to provide an uphole force on the spear engages to the cut segment. The jacking releases the cut segment to then be pulled out of the hole with the BHA. Those skilled in the art will appreciate these and other aspects of the present invention from a review of the description of the preferred embodiment and the associated drawing with the understanding that the full scope of the invention is to be found in the appended claims.

SUMMARY OF THE INVENTION

A bottom hole assembly (BHA) incorporates a tubular cutter driven by a downhole motor. A scraper moves into a smaller tubular to clean an area where a spear will later be engaged to the cut tubular portion. The scraper has a relatively movable mandrel that allows straight through flow into the motor or closes flow to build pressure to a telescoping jack to exert a pull force on the cut tubular after the cut is made. The spear is articulated with mandrel manipulation to grab the cut segment and weight is set down to shift the mandrel in the scraper to allow pressure buildup with rig pumps turned on to retract the jack as the BHA is held with anchors in the larger tubular. The cut segment is pulled uphole to loosen it so it can be removed from the borehole.

DETAILED DESCRIPTION OF THE PREFERRED EMBODIMENT

Figure 1:
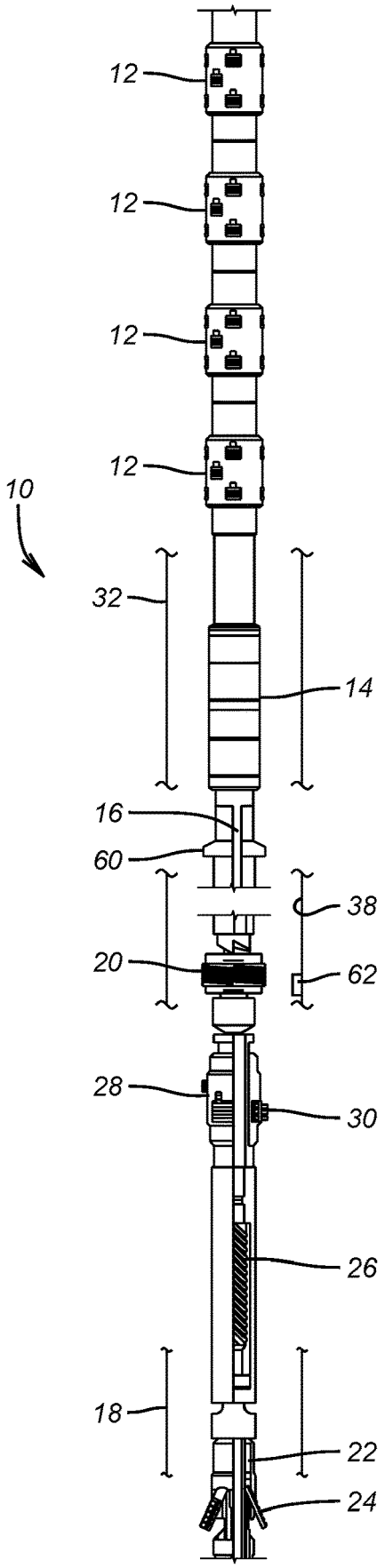
FIG. 1 is an assembly view of the BHA illustrating the arrangement of the individual components.

The bottom hole assembly (BHA) 10 has one or more anchors 12 that selectively extend with internal pressure. A telescoping jack 14 is shown in a fully extended position. It features a fluid access from passage 16 that leads to a piston that is not shown. Application of pressure in passage 16 with jack 14 in the extended position will shorten the overall length of the jack 14 and exert an uphole force to the cut segment 18 when spear 20 is engaged to segment 18. The anchors 12 responsive to pressure in passage 16 extend to brace the jack 14 as it telescopes to decrease in length and to apply an uphole tensile force on the cut segment 18.

A tubular cutter 22 of a type known in the art is responsive to through flow to extend blades 24 to create tubular segment 18. Rotation of blades 24 to sever and create segment 18 is accomplished with a downhole motor 26 that is preferably a progressing cavity motor such as a Moineau that is responsive to flow through the passage 16 to rotate blades 24. Located above the motor 26 is a scraper 28 shown in section in FIG. 2. The scraper 28 has spring loaded scraper segments 30 that extend out radially to create a friction fit inside what will become segment 18 after the cut with blades 24 is made. The scraper segments pass through a larger upper string 32 without significant contact but when advanced into what will become segment 18 create noticeable resistance to further string advancement to serve as a signal for surface personnel that the BHA 10 has advanced into position where the blades 24 are in the vicinity of where the cut should be made.

Figure 2:
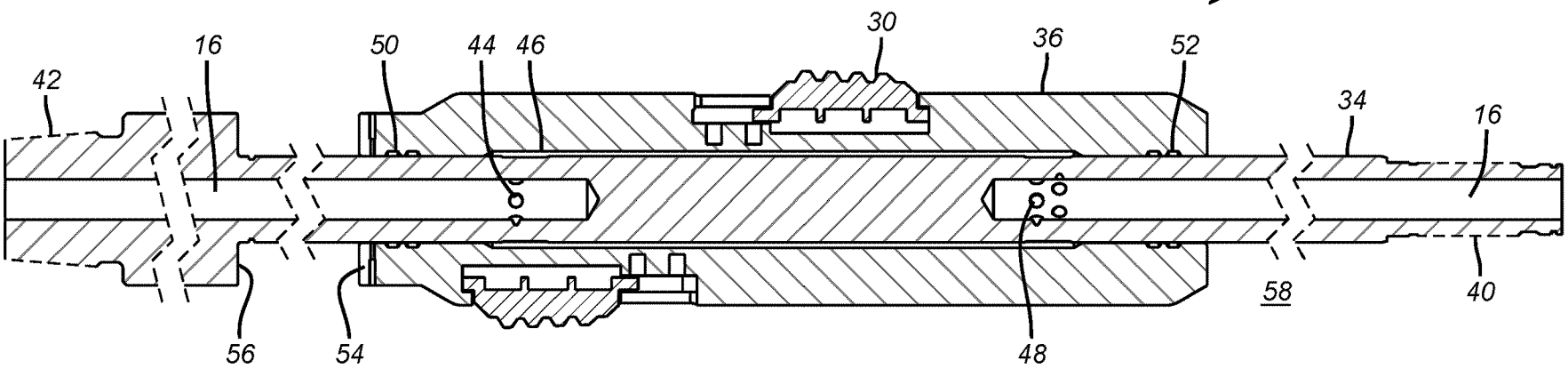
FIG. 2 is a section view through the combination scraper/valve used to redirect BHA flow from the mud motor to pressure buildup in the BHA for operating the telescoping jack.

FIG. 2 illustrates a mandrel 34 with a surrounding housing 36 to which the brush segments 30 are attached for preferably 360 degree scraping coverage of inside wall 38 where spear 20 will ultimately engage to pull the cut segment 18 after the jack 14 is operated with anchors 12 engaged to string 32. Mandrel 34 defines a part of passage 16 that continues to the motor 26 attached at thread 40. At the uphole end thread 42 is where the spear 20 is connected. Flow through passage 16 is through ports 44 that extend laterally into annular space 46 and in turn into lower lateral ports 48 back into passage 16 near threads 40 for flow into the motor 26. Seal or seals 50 close off the upper end of annular space 46, while seal or seals 52 close off the lower end of annular space 46. As such, in the FIG. 2 configuration the flow can reach the motor 26 after passing through the annular space 46 that is open at opposed ends with openings 44 and 48. Seals 50 and 52 maintain the pressure integrity of passage 16 and annular space 46. Outer housing 36 has a top surface 54 that is held in position with the contact of brush segments 30 to inside wall 38. Radial stop surface 56 is designed to land on top surface 54 when weight is set down on mandrel 34 from a remote location. When that happens, openings 48 move past seal or seals 52 to communicate with the surrounding annulus 58 instead of annular space 46. As a result, there is no longer any flow possible to the motor 26 and pressure builds in passage 16 and annular space 46 because the lower end ports 48 are no longer in communication with annular space 46. That built up pressure is used to set anchors 12 and draw uphole the telescoping portion of the jack 14 to release the cut segment 18 from cement that may be around it so that segment 18 can be brought out of the hole. The scraper 28 can be held in the no flow through position for running in to avoid filling the delivery string, not shown, that supports the BHA 10 for running in. This can be done scraper segments 30 radially long enough to hold up the weight of the outer assembly 36 as the BHA 10 is advanced through string 32 which puts the ports 48 outside of housing 36 so that the lower end of the BHA is closed to entrance of well fluid when running in. Other ways of holding ports 48 outside of outer housing 36 can be a breakable member or a mechanical or pressure responsive j-slot mechanism, or a disintegrating retainer to name a few examples.

BHA 10 includes a travel stop 60 that is used to ensure the spear 20 has traveled past its engagement profile schematically illustrated as 62 in inner wall 38.

The major components of the BHA 10 having been described, the sequential operation to accomplish the cutting and removal of the cut segment 18 will now be described. The BHA 10 is passed through tubular string 32 and into what will become the cut segment 18. Segment 18 has a smaller inside diameter than string 32. As the scraper segments 30 pass through string 32 the resistance offered keeps ports 48 outside of outer housing 36 to prevent fluid from entering the string supporting the BHA 10 during running in. As the scraper segments enter the smaller string and soon to be segment 18 additional resistance to further travel is sensed by operating personnel and further advancement is stopped short of the stop 60. The reason for this is that the spear 20 will not engage as the lower portion of the BHA 10 is raised when backpressure in the passage 16 extends anchors 12 in string 32 and shortens the jack 14 hydraulically. What does happen on lowering the BHA 10 is that scraper segments 30 scrape wall 38 in the region where the spear 20 will later get a grip. After the initial setting down to scrape with scraper segments 30, the surface pumps are started after picking up puts the scraper 28 in the flow through position. Again, at this time the stop 60 has not engaged what will be the top of segment 18. Flow through the motor 26 extends blades 24 and starts them rotating to make a cut. The backpressure in passage 16 extends anchors 12 in string 32 and contracts the jack 14. Contracting jack 14 with blades 24 extended and starting to rotate will simply raise the blades 24 initially as they speed up for the length of the stroke of the jack which is about 0.5 meter. This does no damage as at this time the spear 20 is not engaged to profile 62. As the conclusion of the cut to create the segment 18 the pumps are turned off. This retracts the anchors 12 and allows the jack to extend as the BHA 10 is picked up. The BHA 10 is lowered to engage the travel stop 60 to the top of what is now segment 18. This time the BHA 10 descends low enough so that on picking up the spear 20 engages profile 62 for a grip on the segment 18. The BHA is then lowered to close off passage 16 in the scraper 28 so that turning on the pumps at the surface will not allow pressure to reach the motor 26 and instead, pressure will build in passage 16 to extend the anchors 12 and to actuate the jack 14 hydraulically to shorten. At this time since the spear 20 is gripping the segment 18 an uphole pull is transmitted to the segment 18 to break it loose from cement that is external to it so that it can be pulled out of the hole.

Those skilled in the art will now appreciate that the above described assembly and method allows a single trip in the hole with a BHA that will sever the tubing and grip the severed section and apply an uphole pull to break the segment free for subsequent removal from the hole so that additional steps can be taken such as plugging and abandonment, for example. The unique diverter valve is integrated into a scraper that cleans a zone where the spear will be engaged to the severed segment. While the spear and the scraper themselves are known devices in the art, the combination of a diverter tool with another functioning tool is new and allows selective isolation of a downhole motor so that pressure in the BHA string can build and operate the downhole jack for a pulling force on the cut segment with the spear already engaged to it. String rotation from the surface is not required. Running in without taking fluid in the string is also possible as the advancement of the string with the scraper brush segments providing resistance to a scraper outer housing allows the diverter valve in the scraper to be closed to straight through flow to keep well fluids out of the string when running in.

The above description is illustrative of the preferred embodiment and many modifications may be made by those skilled in the art without departing from the invention whose scope is to be determined from the literal and equivalent scope of the claims below:

We claim:

1. A bottom hole assembly for cutting a tubular string and applying a pulling force to the cut segment, comprising:

a fluid motor selectively driving a tubular cutter;

a selectively operated diverter valve mounted between said fluid motor and a hydraulic jack;

said diverter valve selectively allowing flow in a first configuration to reach said fluid motor for operating said cutter to create a segment of the tubular string and blocking flow to said fluid motor in a second configuration to build pressure in said hydraulic jack for exertion of a tensile force on the segment of the tubular string to facilitate release of the segment of the tubular string for removal from a borehole;

said diverter valve comprises a moveable mandrel in a housing;

said mandrel comprises spaced first and second openings selectively positioned into an annular space defined between said mandrel and said housing;

said annular space is disposed between spaced first and second seals for pressure retention in said annular space; and flow to said fluid motor through said annular space is enabled when said spaced first and second openings are positioned between said first and second seals.

2. The assembly of claim 1, wherein:

said housing comprises at least one tool configured to engage an inner wall of the tubular string to provide housing support to retain said housing stationary, which enables said mandrel to move relatively to said housing.

3. The assembly of claim 1, wherein:

flow to said fluid motor through said annular space is enabled when said spaced first and second openings are positioned between said first and second seals.

4. The assembly of claim 3, wherein:

flow to said fluid motor through said annular space is blocked when one of said spaced first and second openings are positioned beyond one of said first and second seals.

5. The assembly of claim 4, wherein:

said first and second seals are mounted to said housing.

6. The assembly of claim 4, further comprising:

said tool comprises at least one scraper segment on said housing.

7. The assembly of claim 6, further comprising:

a grip tool selectively engaged to a portion of the inner wall previously scraped by said at least one scraper segment.

8. The assembly of claim 7, wherein:

said grip tool is selectively engaged to the inner wall after a travel stop is landed on a top of the tubular string and said grip tool is lifted into a profile on the inner wall.

9. The assembly of claim 8, wherein:

said motor drives said cutter before said travel stop is landed on the top of the tubular string.

10. The assembly of claim 4, wherein:

one of said spaced first and second openings are positioned beyond one of said first and second seals to prevent flow to said fluid motor with setting down weight on said mandrel.

11. The assembly of claim 10, further comprising:

a grip tool selectively engaging the inner wall of the tubular string;

said hydraulic jack comprises at least one hydraulic anchor settable beyond a top of the tubular string, whereupon said grip tool engaging the inner wall of the tubular string built fluid pressure on said diverter valve with said fluid motor isolated sets said at least one anchor and moves said hydraulic jack to exert a tensile force on the segment of the tubular string created by said fluid motor operating said cutter.

12. The assembly of claim 11, wherein:

said hydraulic jack releases the segment of the tubular string from the borehole, whereupon removal of hydraulic pressure to said hydraulic jack and said at least one hydraulic anchor the segment of the tubular string is removed with the bottom hole assembly while supported by said grip tool.

* * * * *